US011982047B2

(12) United States Patent
Xing et al.

(10) Patent No.: US 11,982,047 B2
(45) Date of Patent: May 14, 2024

(54) SILVER-PLATED CONDUCTIVE NYLON FIBER AND PREPARATION METHOD THEREOF

(71) Applicant: SOOCHOW UNIVERSITY, Suzhou (CN)

(72) Inventors: Tieling Xing, Suzhou (CN); Xin Ai, Suzhou (CN); Ailing Xie, Suzhou (CN); Shenzhou Lu, Suzhou (CN); Guoqiang Chen, Suzhou (CN)

(73) Assignee: SOOCHOW UNIVERSITY, Suzhou (CN)

( * ) Notice: Subject to any disclaimer, the term of this patent is extended or adjusted under 35 U.S.C. 154(b) by 177 days.

(21) Appl. No.: 17/798,179

(22) PCT Filed: Jun. 4, 2021

(86) PCT No.: PCT/CN2021/098235

§ 371 (c)(1),
(2) Date: Aug. 8, 2022

(87) PCT Pub. No.: WO2022/252199

PCT Pub. Date: Dec. 8, 2022

(65) Prior Publication Data

US 2024/0026601 A1 Jan. 25, 2024

(30) Foreign Application Priority Data

May 31, 2021 (CN) ..... 202110603872.7

(51) Int. Cl.
*D06M 11/83* (2006.01)
*D06M 13/175* (2006.01)
(Continued)

(52) U.S. Cl.
CPC ..... *D06M 11/83* (2013.01); *D06M 13/175* (2013.01); *D06M 13/207* (2013.01);
(Continued)

(58) Field of Classification Search
None
See application file for complete search history.

(56) References Cited

U.S. PATENT DOCUMENTS

| | | | | |
|---|---|---|---|---|
| 3,003,975 | A | 10/1961 | Louis | |
| 4,362,779 | A | 12/1982 | Arsac | |
| 2021/0032755 | A1 * | 2/2021 | Philibert | C23C 18/42 |

FOREIGN PATENT DOCUMENTS

| | | | |
|---|---|---|---|
| CN | 106917075 | A | 7/2017 |
| CN | 109161876 | A | 1/2019 |
| CN | 111005215 | A | 4/2020 |

* cited by examiner

*Primary Examiner* — Michael P. Rodriguez
(74) *Attorney, Agent, or Firm* — SZDC Law PC

(57) ABSTRACT

The invention provides a silver-plated conductive nylon fiber and a preparation method thereof. The method includes: immersing a nylon fiber in an aqueous solution containing a polyphenolic compound at 60° C. to 70° C., adding a water-soluble oxidant into the solution, continuously reacting at 70° C. to 80° C., and obtaining a polyphenol grafted nylon fiber, where the polyphenolic compound contains a catechol group; immersing the polyphenol grafted nylon fiber into a solution containing silver ions at 15° C. to 25° C. for reaction, and raising the temperature to 70° C. to 80° C. for continuous reaction to obtain a surface-activated nylon fiber; and carrying out chemical silver plating treatment on the surface-activated nylon fiber to obtain the silver-plated conductive nylon fiber. The method does not require a heavy metal sensitizer and therefore is non-toxic and environment-friendly, and the fiber strength is maintained.

10 Claims, 1 Drawing Sheet

(51) Int. Cl.

| | |
|---|---|
| ***D06M 13/207*** | (2006.01) |
| ***D06M 13/224*** | (2006.01) |
| ***D06M 13/238*** | (2006.01) |
| *D06M 101/34* | (2006.01) |

(52) U.S. Cl.
CPC ..... *D06M 13/2246* (2013.01); *D06M 13/238* (2013.01); *D06M 2101/34* (2013.01); *D06M 2200/00* (2013.01)

b) $(R_2C{=}O + R'NH_2 \longrightarrow R_2C{=}NR' + H_2O)$

SILVER-PLATED CONDUCTIVE NYLON FIBER AND PREPARATION METHOD THEREOF

This application is the National Stage Application of PCT/CN2021/098235, filed on Jun. 4, 2021, which claims priority to Chinese Patent Application No. CN 202110603872.7, filed on May 31, 2021, which is incorporated by reference for all purposes as if fully set forth herein.

FIELD OF THE INVENTION

The invention relates to the technical field of fiber modification and preparation, and specifically to a silver-plated conductive nylon fiber and a preparation method thereof.

DESCRIPTION OF THE RELATED ART

With the development of industry, the types and quantities of various household appliances and electronic devices are increasing, and people pay more and more attention to antistatic fibers. Therefore, the technologies for preparing conductive fibers are also constantly developing. One of the main technologies is preparing conductive fibers by chemical silver plating. Among numerous fibers, nylon fibers have a smooth surface and a complete structure and few active reactive groups. Therefore, how to improve the conductivity of nylon fibers has always been one of the main challenges for antistatic fibers.

Biomimetic mussel chemistry, represented by the oxidative self-polymerization of polyphenols, has attracted great attention in the material industry due to its high utilization rate, excellent effect and environment-friendliness, and has been widely used in surface and interface modification and functionalization of materials. The invention patent with an application number of CN 201811166015.x discloses a novel environment-friendly natural textile dye prepared by oxidative self-polymerization of tea polyphenols. The invention patent with an application number of CN 202011158029.4 discloses a tea polyphenol-rich skincare antibacterial tea fiber and a preparation method thereof. The invention patent with an application number of CN 202010492930.9 discloses a method for preparing a filtration membrane by modifying a nanofiber coating base with polydopamine.

The application of silver-plated conductive nylon fibers is very extensive. At present, the method of chemical silver plating is mainly used to metalize the surface of nylon fibers. The invention patent with an application number of CN 201011373886.3 discloses a method for preparing silver-plated conductive nylon fibers by sensitizing nylon fibers using stannous chloride. The invention patent with an application number of CN 201910343930.X discloses an anti-oxidation silver-plated nylon fiber with a protective film. The invention patent with an application number of CN 201410148781.9 discloses a method for preparing a silver-plated electromagnetic shielding lining cloth from silver-plated nylon.

The common disadvantage of the current chemical silver plating processes is that stannous chloride used as the sensitizer in the chemical silver plating process is highly toxic, and it is easy to cause respiratory infections and skin diseases in the production and processing process. Therefore, it has extremely high requirements on production workshops, production equipment and worker protection. In addition, the surface of nylon is smooth with few reactive groups, and is often pretreated with a strong oxidant, resulting in a significant decrease in the strength of nylon fibers. If the surface of nylon is not pretreated with a strong oxidant, the silver coating is not firmly bonded to the nylon fiber and easily falls off. Therefore, developing a method for preparing conductive nylon fibers in an environment-friendly manner while maintaining the strength of nylon fibers and ensuring firm bonding between the silver coating and the nylon fibers without using a heavy metal sensitizer and pretreatment with a strong oxidant is critical for the development of antistatic, electromagnetic shielding, composite material, and other fields.

SUMMARY OF THE INVENTION

An object of the invention is to provide a silver-plated conductive nylon fiber and a preparation method thereof. This method does not use a heavy metal sensitizer and does not need pretreatment with a strong oxidant, so that the strength of nylon fibers is maintained, and the silver coating is firmly bonded to the nylon fibers.

The object of the invention is accomplished through the following technical solutions:

The invention provides a method for preparing a silver-plated conductive nylon fiber, including the following steps:

(1) immersing a nylon fiber in an aqueous solution containing a polyphenolic compound at 60° C. to 70° C., adding a water-soluble oxidant into the solution, and continuously reacting at 70° C. to 80° C., and thus obtaining a polyphenol-grafted nylon fiber after the reaction is completed, wherein the polyphenolic compound is a polyphenolic compound containing a catechol group, the aqueous solution of the polyphenolic compound has a concentration of 1 g/L to 5 g/L; and preferably, the reaction time is 20 to 100 min, and further preferably, the water-soluble oxidant is selected from the group consisting of sodium perborate, potassium perborate, sodium persulfate and any combination thereof; and (2) immersing the polyphenol-grafted nylon fiber obtained in the step (1) into a solution containing silver ions at 15° C. to 25° C. for reaction, wherein the reaction time is preferably 2 to 20 min, and raising the temperature to 70° C. to 80° C. for continuous reaction to obtain a surface-activated nylon fiber, wherein in the solution containing silver ions, the concentration of silver ions is $1\times10^{-5}$ mol/L to $3\times10^{-5}$ mol/L; preferably, the reaction time is 10 to 30 min; and a low-concentration silver nitrate solution is used as a activator to create more redox reaction centers during chemical silver plating on the surface of the polyphenol-polymerized nylon fiber; and (3) carrying out chemical silver plating treatment on the surface-activated nylon fiber obtained in the step (2) to obtain the silver-plated conductive nylon fiber.

Preferably, before the step (1), the method further includes step (la): soaking the nylon fiber in sulfuric acid with a concentration of 20 mL/L to 100 mL/L at 40° C. to 60° C. for 20 to 120 min, followed by washing and dehydration. This step can coarsen the fiber surface and provide more reaction sites.

Preferably, the chemical silver plating includes: soaking the surface-activated nylon fiber obtained in the step (2) in a silver ammonia solution added with a reducing agent at 30° C. to 50° C. for reaction for 20 to 90 min. The treated fiber surface is covered with a layer of dense elemental silver by the silver mirror reaction under weak alkaline conditions.

Preferably, the reducing agent is selected from the group consisting of glucose, acetaldehyde, formaldehyde and any combination thereof.

Preferably, the silver ammonia solution is further added with a surfactant.

Preferably, the surfactant includes polyvinylpyrrolidone and/or sodium dodecylbenzenesulfonate. Preferably, the molecular weight of polyvinylpyrrolidone is 500,000 to 1,300,000. The surfactant can adjust the deposition rate, improve the gloss of the coating, and improve the surface evenness and smoothness of the coating.

Preferably, the surfactant has a concentration of 5 g/L to 15 g/L.

Preferably, in the step (1), the polyphenolic compound is selected from the group consisting of eugenol, tannic acid, ferulic acid, chlorogenic acid and any combination thereof; the water-soluble oxidant is selected from the group consisting of sodium perborate, sodium persulfate, potassium perborate and any combination thereof; and in the reaction solution, the water-soluble oxidant has a concentration of 1 g/L to 3 g/L. After the polyphenolic compound is polymerized, a polymerized polyphenolic layer can be formed, which has high adhesion and can serve as a secondary reaction platform.

Preferably, after the step (3), the method further includes a step (4): washing and dehydrating the silver-plated conductive nylon fiber, and drying at 90° C. to 140° C. for 2 to 10 min.

In the invention, the biomimetic mussel chemistry represented by the oxidative self-polymerization of polyphenols replaces the sensitizer stannous chloride in the conventional processes with natural polyphenols, which is environment-friendly and ensures that the fiber strength is hardly affected. The polymerized polyphenol has strong adhesion, can be deposited on various materials as a secondary reaction platform, and can also well ensure the fastness after silver plating. Compared with the conventional methods for preparing silver-plated conductive fibers, the invention provides a new idea for preparing a novel silver-plated conductive nylon fiber.

Another object of the invention is to provide a silver-plated conductive nylon fiber, which is prepared by any of the above preparation method.

Preferably, the silver-plated conductive nylon fiber of the invention includes a nylon fiber body, where a polymerized polyphenolic layer and a conductive layer are provided on the surface of the nylon fiber body in sequence from the inside to the outside, and the conductive layer includes a plurality of silver nanoparticles.

Preferably, the thickness of the conductive layer is 50 nm to 400 nm.

Preferably, the thickness of the polymerized polyphenolic layer is 1.5 nm to 2.2 μm.

The principle underlying the preparation method provided in the invention is as follows.

First, the surface of the fiber is optionally coarsened with sulfuric acid, which can degrade part of the polyamide and expose more reactive sites such as carboxyl and amino groups on the surface of the nylon fiber. Then polyphenols are easily oxidized and self-polymerized in the presence of an oxidant under alkaline conditions, where the catechol group is induced to be oxidized to quinone, which undergoes Michael addition and Schiff reaction with the amino groups on the surface of the nylon fiber (see FIG. 2 for the relevant reaction formula), and the polymerized polyphenol is fixed on the surface of the nylon fiber by a covalent bond. Secondly, based on the conjugation between the polymerized polyphenol and silver ions and the charge transfer of the hydroquinone charges in the polymerized polyphenol in the process of transferring complexes, an effective adsorption layer is constructed for adsorption of silver ions, and then through in-situ reduction of silver ions at high temperature, active centers of silver nanoparticles are formed, thereby promoting the rapid reduction of silver ions in the subsequent reduction process and the uniform dispersion of silver ions on the fiber surface. Therefore, the polymerized polyphenol can be used to improve the active sites on the fiber surface and promote the deposition of silver. During chemical silver plating, a galvanic reaction is formed on the active centers of nano-silver, the reducing agent oxidizes on the surface of the active centers of nano-silver, and electrons are released. The electrons are conducted to free silver ions through the active centers of nano-silver. The silver ions obtain electrons and are reduced to silver element, which is incorporated into lattices of the active centers of nano-silver. The lattices grow to form a chemically plated silver layer.

By means of the above solution, the invention has the following advantages.

The method for preparing a silver-plated conductive nylon fiber provided by the invention can achieve the sensitization effect without using a heavy metal sensitizer, such as stannous chloride. The preparation process is non-toxic and environment-friendly. The preparation method does not require pretreatment of the nylon fiber with a strong oxidant, so that the strength of the nylon fiber is maintained, and a strong bonding force can be achieved between the silver coating and the nylon fiber. The polymerized polyphenol on the fiber surface has strong adhesion and can be used as a reaction platform for silver plating to improve the fastness of silver plated and prolong the service life. The preparation method is of low energy consumption, short reaction period, simple operation, and high energy utilization rate, and can expand the use value of nylon fibers and increase the additional value of products.

The silver-plated conductive nylon fiber provided by the invention has the advantages of high fiber strength and firm bonding of the coating which does not easily fall off. In addition, the polymerized polyphenol has good biocompatibility, and naturally has antibacterial, anti-mite and other properties. Therefore, the prepared conductive nylon fiber integrates multiple functions.

The above description is only a summary of the technical solutions of the invention. To make the technical means of the invention clearer and implementable in accordance with the disclosure of the specification, the preferred embodiments of the invention will be described in detail with reference to the accompanying drawings.

BRIEF DESCRIPTION OF THE DRAWINGS

FIG. 2(*b*) shows a Schiff reaction formula involved in the principle of the preparation method.

DETAILED DESCRIPTION OF THE PREFERRED EMBODIMENTS

Figure 1:
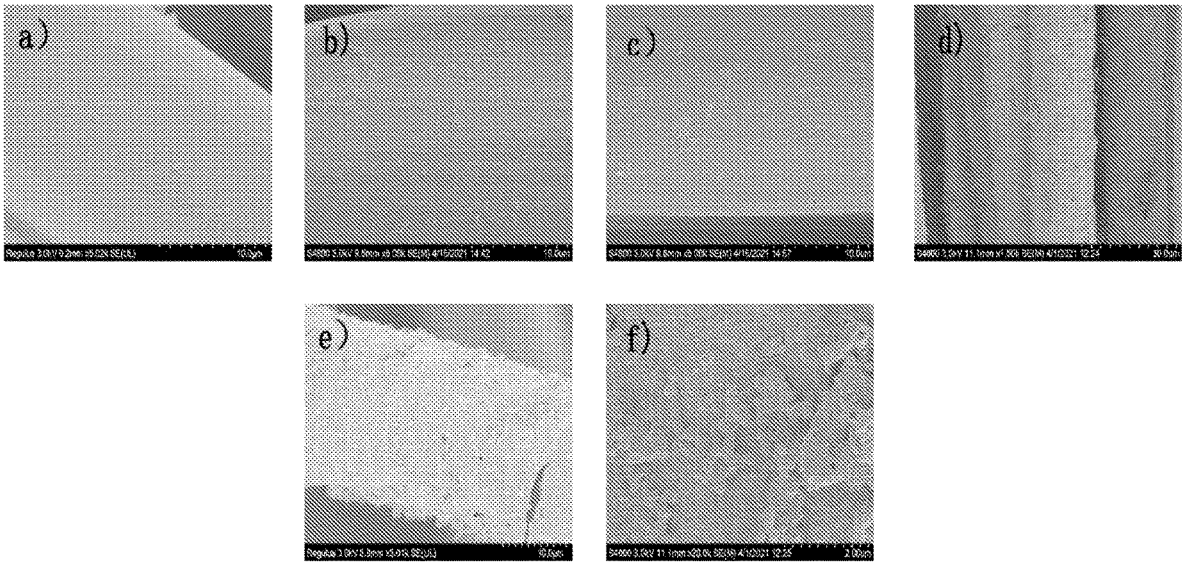
FIG. 1 shows SEM images of the surface of the nylon fiber before treatment (a), after treatment by polymerized tannic acid in Example 1 (b), after treatment by silver nitrate activation in Example 1 (c), after treatment in Example 1 (d), and after treatment in Example 2 (e), and an SEM image of grains on the surface of the nylon fiber after treatment in Example 2 (f).
Figure 2:
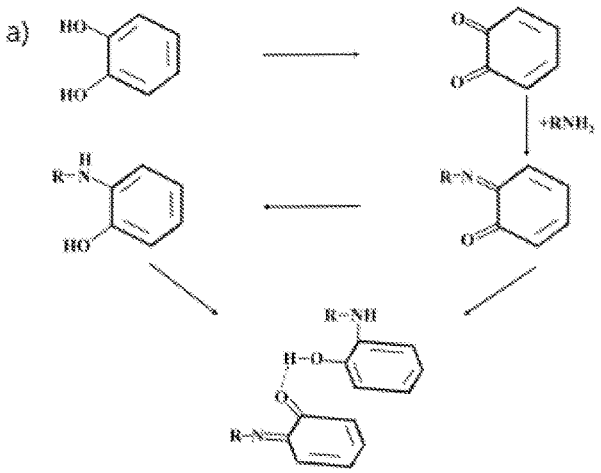
FIG. 2(*a*) shows a Michael addition reaction formula involved in the principle of the preparation method.

The specific embodiments of the invention will be described in further detail with reference to tables and examples. The following examples are intended to illustrate the invention, instead of limiting the scope of the invention.

Example 1 a) Cleaning of nylon 56 fiber: The nylon 56 fiber was cleaned with a detergent to remove oil and dirt on the nylon surface for later use.
b) Coarsening of nylon fiber: The nylon 56 fiber was immersed in sulfuric acid with a concentration of 20 mL/L at 40° C. for 30 min, and then washed and dehydrated.
c) Polymerization of polyphenols on the fiber surface: The nylon 56 fiber coarsened in the step b) was immersed in an aqueous solution containing 1 g/L of tannic acid, and shaken at 70° C. for 30 min. Sodium perborate was added to the aqueous solution until the concentration reached 3 g/L. The resultant aqueous solution was shaken at 70° C. for 30 min to polymerize the polyphenols on the fiber surface. Then the fiber was taken out, washed and dehydrated.
d) Formation of active centers: A low-concentration silver nitrate solution was prepared. The fiber obtained in the step c) was immersed in the solution for 10 min. Then the temperature was raised to 80° C., and after the reaction was carried out under shaking for 10 min, the fiber was taken out and dehydrated to obtain surface-activated nylon 56 fiber with a large number of reaction centers.
e) Silver plating on fiber surface: A silver nitrate aqueous solution of 10 g/L concentration was prepared. Aqueous ammonia was added dropwise to the silver nitrate aqueous solution, and the solution was precipitated subsequently. Aqueous ammonia was continuously added dropwise until the precipitation completely disappears to obtain a silver ammonia solution. Polyvinylpyrrolidone with a molecular weight of 1,300,000 and a concentration of 0.05 g/L was added to the silver ammonia solution, followed by the addition of glucose with a concentration of 40 g/L. The nylon 56 fiber treated in the step d) was immersed in the solution, and reacted under stirring at 30° C. for 20 min, so that the fiber surface fully underwent a redox reaction.
f) Cleaning and solidifying: The nylon fiber was taken out, washed thoroughly with water, and quickly dried at 100° C. for 7 min to obtain a silver-plated conductive nylon 56 fiber modified by the polyphenolic compound.

FIG. 1(*a*) shows an SEM image of the surface of the nylon 56 fiber before treatment in the step a). FIG. 1(*b*) shows an SEM image of the surface of the nylon 56 fiber after treatment by polymerized tannic acid in the step c). FIG. 1(*c*) shows an SEM image of the surface of the nylon 56 fiber after activation treatment by low-concentration silver nitrate in the step d). FIG. 1(*d*) shows a low-magnification SEM image of the surface of the nylon 56 fiber after treatment. It can be seen that before treatment, the surface of the nylon 56 fiber was smooth; after the polymerization of tannic acid, the surface of the fiber was covered with a layer of dense polymerized polyphenol; after activation treatment by low-concentration silver nitrate, many nano-silver reaction centers for subsequent reactions were adhered to the fiber surface; and after silver plating, the surface of the fiber was covered with a layer of dense silver elemental grains, and the surface was coarse. As can be seen from Table 1, the treated nylon 56 fiber had good electrical conductivity.

Example 2 a) Cleaning of nylon 56 fiber: The nylon 56 fiber was cleaned with a detergent to remove oil and dirt on the nylon surface for later use.
b) Coarsening of nylon 56 fiber: The nylon 56 fiber was immersed in sulfuric acid with a concentration of 20 mL/L at 40° C. for 30 min, and then washed and dehydrated.
c) Polymerization of polyphenols on the fiber surface: The nylon fiber coarsened in the step b) was immersed in an aqueous solution containing 2 g/L of ferulic acid, and shaken at 75° C. for 25 min. Sodium perborate was added to the aqueous solution until the concentration reached 2 g/L. The resultant aqueous solution was shaken at 75° C. for 25 min to polymerize the polyphenols on the fiber surface. Then the fiber was taken out, washed and dehydrated.
d) Formation of active centers: A low-concentration silver nitrate solution was prepared. The fiber obtained in the step c) was immersed in the solution for 20 min. Then the temperature was raised to 80° C., and after the reaction was shaken carried out under shaking for 20 min, the fiber was taken out and dehydrated to obtain surface-activated nylon 56 fiber with a large number of reaction centers.
e) Silver plating on fiber surface: A silver nitrate aqueous solution of 10 g/L concentration was prepared. Aqueous ammonia was added dropwise to the silver nitrate aqueous solution, and the solution was precipitated subsequently. Aqueous ammonia was continuously added dropwise until the precipitation completely disappears to obtain a silver ammonia solution. Polyvinylpyrrolidone with a molecular weight of 1,000,000 and concentration of 0.1 g/L was added to the silver ammonia solution, followed by the addition of glucose with a concentration of 30 g/L. The nylon 56 fiber treated in the step d) was immersed in the solution, and reacted under stirring at 50° C. for 70 min, so that the fiber surface fully underwent a redox reaction.
f) Cleaning and solidifying: The nylon fiber was taken out, washed thoroughly with water, and quickly dried at 110° C. for 5 min to obtain a silver-plated conductive nylon 56 fiber modified by the polyphenolic compound.

FIG. 1(*e*) shows a low-magnification SEM image of the surface of the nylon 56 fiber after treatment by the step f) in this example. FIG. 1(*f*) shows an SEM image of nano-scale silver on the surface of the nylon 56 fiber after treatment by the step f) in this example. It can be clearly seen that the surface of the fiber was covered with a layer of dense silver elemental grains, and the surface was rough. As can be seen from Table 1, the treated nylon 56 fiber had good electrical conductivity.

Example 3 a) Cleaning of nylon 56 fiber: The nylon fiber was cleaned with a detergent to remove oil and dirt on the nylon surface for later use.
b) Coarsening of nylon 56 fiber: The nylon 56 fiber was immersed in sulfuric acid with a concentration of 20 mL/L at 40° C. for 30 min, and then washed and dehydrated.
c) Polymerization of polyphenols on the fiber surface: The nylon fiber coarsened in the step b) was immersed in an aqueous solution containing 1 g/L of eugenol, and shaken at 80° C. for 20 min. Sodium persulfate was added to the aqueous solution until the concentration reached 2 g/L. The resultant aqueous solution was shaken at 80° C. for 25 min to polymerize the polyphenols on the fiber surface. Then the fiber was taken out, washed and dehydrated.

d) Formation of active centers: A low-concentration silver nitrate solution was prepared. The fiber obtained in the step c) was immersed in the solution for 20 min. Then the temperature was raised to 70° C., and after the reaction was carried out under shaking for 20 min, the fiber was taken out and dehydrated to obtain surface-activated nylon 56 fiber with a large number of reaction centers.

e) Silver plating on fiber surface: A silver nitrate aqueous solution of 5 g/L concentration was prepared. Aqueous ammonia was added dropwise to the silver nitrate aqueous solution, and the solution was precipitated subsequently. Aqueous ammonia was continuously added dropwise until the precipitation completely disappears to obtain a silver ammonia solution. Sodium dodecylbenzenesulfonate with a concentration of 0.08 g/L was added to the silver ammonia solution, followed by the addition of glucose with a concentration of 20 g/L. The nylon 56 fiber treated in the step d) was immersed in the solution, and reacted under stirring at 30° C. for 60 min, so that the fiber surface fully underwent a redox reaction.

f) Cleaning and solidifying: The nylon fiber was taken out, washed thoroughly with water, and quickly dried at 120° C. for 3 min to obtain a silver-plated conductive nylon 56 fiber modified by the polyphenolic compound.

The surface of the nylon 56 fiber treated with eugenol was covered with dense silver elemental grains, and the fiber surface was rough, had certain fastness and strength, and had good electrical conductivity.

Example 4 a) Cleaning of nylon 56 fiber: The nylon 56 fiber was cleaned with a detergent to remove oil and dirt on the nylon surface for later use.

b) Coarsening of nylon 56 fiber: The nylon 56 fiber was immersed in sulfuric acid with a concentration of 30 mL/L at 40° C. for 30 min, and then washed and dehydrated.

c) Polymerization of polyphenols on the fiber surface: The nylon 56 fiber coarsened in the step b) was immersed in an aqueous solution containing 1 g/L of chlorogenic acid, and shaken at 75° C. for 20 min. Sodium perborate was added to the aqueous solution until the concentration reached 3 g/L. The resulting aqueous solution was shaken at 75° C. for 30 min to polymerize the polyphenols on the fiber surface. Then the fiber was taken out, washed and dehydrated.

d) Formation of active centers: A low-concentration silver nitrate solution was prepared. The fiber obtained in the step c) was immersed in the solution for 20 min. Then the temperature was raised to 70° C., and after the reaction was carried out under shaking for 10 min, the fiber was taken out and dehydrated to obtain surface-activated nylon 56 fiber with a large number of reaction centers.

e) Silver plating on fiber surface: A silver nitrate aqueous solution of 10 g/L concentration was prepared. Aqueous ammonia was added dropwise to the silver nitrate aqueous solution, and the solution was precipitated subsequently. Aqueous ammonia was continuously added dropwise until the precipitation completely disappears to obtain a silver ammonia solution. Polyvinylpyrrolidone with a molecular weight of 1,300,000 and concentration of 0.1 g/L was added to the silver ammonia solution, followed by the addition of glucose with a concentration of 30 g/L. The nylon 6 fiber treated in the step d) was immersed in the solution, and reacted under stirring at 50° C. for 30 min, so that the fiber surface fully underwent a redox reaction.

f) Cleaning and solidifying: The nylon fiber was taken out, washed thoroughly with water, and quickly dried at a high temperature of 80° C. for 30 min to obtain a silver-plated conductive nylon 56 fiber modified by the polyphenolic compound.

The surface of the nylon 56 fiber treated with chlorogenic acid was covered with dense silver elemental grains, and the fiber surface was rough, had certain fastness and strength, and had good electrical conductivity.

Example 5 a) Cleaning of nylon 66 fiber: The nylon 66 fiber was cleaned with a detergent to remove oil and dirt on the nylon surface for later use.

b) Coarsening of nylon 66 fiber: The nylon 66 fiber was immersed in sulfuric acid with a concentration of 20 mL/L at 40° C. for 30 min, and then washed and dehydrated.

c) Polymerization of polyphenols on the fiber surface: The nylon 66 fiber coarsened in the step b) was immersed in an aqueous solution containing 1 g/L of ferulic acid, and shaken at 75° C. for 20 min. Potassium perborate was added to the aqueous solution until the concentration reached 3 g/L. The resultant aqueous solution was shaken at 75° C. for 30 min to polymerize the polyphenols on the fiber surface. Then the fiber was taken out, washed and dehydrated.

d) Formation of active centers: A low-concentration silver nitrate solution was prepared. The fiber obtained in the step c) was immersed in the solution for 10 min. Then the temperature was raised to 80° C., and after the reaction was carried out under shaking for 20 min, the fiber was taken out and dehydrated to obtain surface-activated nylon 66 fiber with a large number of reaction centers.

e) Silver plating on fiber surface: A silver nitrate aqueous solution of 10 g/L concentration was prepared. Aqueous ammonia was added dropwise to the silver nitrate aqueous solution, and the solution was precipitated subsequently. Aqueous ammonia was continuously added dropwise until the precipitation completely disappears to obtain a silver ammonia solution. Polyvinylpyrrolidone with a molecular weight of 500000 and concentration of 0.2 g/L was added to the silver ammonia solution, followed by the addition of glucose with a concentration of 10 g/L. The nylon 66 fiber treated in the step d) was immersed in the solution, and reacted under stirring at 30° C. for 60 min, so that the fiber surface fully underwent a redox reaction.

f) Cleaning and solidifying: The nylon fiber was taken out, washed thoroughly with water, and quickly dried at 90° C. for 10 min to obtain a silver-plated conductive nylon 66 fiber modified by the polyphenolic compound.

The surface of the nylon 66 fiber treated with ferulic acid was covered with dense silver elemental grains, and the fiber surface was rough, had certain fastness and strength, and had good electrical conductivity.

Example 6 a) Cleaning of nylon 6 fiber: The nylon 6 fiber was cleaned with a detergent to remove oil and dirt on the nylon surface for later use.

b) Coarsening of nylon 6 fiber: The nylon 6 fiber was immersed in sulfuric acid with a concentration of 30 mL/L at 40° C. for 30 min, and then washed and dehydrated.

c) Polymerization of polyphenols on the fiber surface: The nylon 6 fiber coarsened in the step b) was immersed in an aqueous solution containing 1 g/L of eugenol, and shaken at 75° C. for 20 min. Sodium perborate was added to the aqueous solution until the concentration reached 3 g/L. The resultant aqueous solution was shaken at 75° C. for 30 min to polymerize the polyphenols on the fiber surface. Then the fiber was taken out, washed and dehydrated.

d) Formation of active centers: A low-concentration silver nitrate solution was prepared. The fiber obtained in the step c) was immersed in the solution for 20 min. Then the temperature was raised to 70° C., and after the reaction was carried out under shaking for 10 min, the fiber was taken out and dehydrated to obtain surface-activated nylon 6 fiber with a large number of reaction centers.

e) Silver plating on fiber surface: A silver nitrate aqueous solution of 10 g/L concentration was prepared. Aqueous ammonia was added dropwise to the silver nitrate aqueous solution, and the solution was precipitated subsequently. Aqueous ammonia was continuously added dropwise until the precipitation completely disappears to obtain a silver ammonia solution. Polyvinylpyrrolidone with a molecular weight of 1,300,000 and concentration of 0.1 g/L was added to the silver ammonia solution, followed by the addition of glucose with a concentration of 30 g/L. The nylon 6 fiber treated in the step d) was immersed in the solution, and reacted under stirring at 50° C. for 30 min, so that the fiber surface fully underwent a redox reaction.

f) Cleaning and solidifying: The nylon fiber was taken out, washed thoroughly with water, and quickly dried at 110° C. for 8 min to obtain a silver-plated conductive nylon 6 fiber modified by the polyphenolic compound.

The surface of the nylon 6 fiber treated with eugenol was covered with dense silver elemental grains, and the fiber surface was rough, had certain fastness and strength, and had good electrical conductivity.

Performance Tests

A fiber mechanical test (according to GB/T 14337-2008), electrical performance test (according to FZ/T 52032-2014), and fastness to soaping test (according to GB/T 14337-2008) were carried out on the conductive fibers prepared in the above examples. The results are shown in Tables 1 to 3.

TABLE 1

Resistance of silver-coated conductive nylon fibers prepared in different examples

| | Examples | | | | | |
|---|---|---|---|---|---|---|
| | Example 1 | Example 2 | Example 3 | Example 4 | Example 5 | Example 6 |
| Electrical conductivity S/m | 183.15 | 47.78 | 109.89 | 122.10 | 33.30 | 1861.05 |

TABLE 2

Changes in fiber strength at different stages in Example 1

| Stage | Before treatment | After coarsening with sulfuric acid | After polymerization of tannic acid | After silver plating |
|---|---|---|---|---|
| Strength cN/cm | 386 | 357 | 350 | 344 |

TABLE 3

Fastness to soaping of silver-plated conductive nylon fibers prepared in Example 1

| Soaping times | 1 | 2 | 3 | 4 | 5 |
|---|---|---|---|---|---|
| Electrical conductivity S/m | 138.05 | 118.15 | 116.76 | 111.35 | 110.87 |
| Soaping times | 6 | 7 | 8 | 9 | 10 |
| Electrical conductivity S/m | 108.94 | 108.25 | 107.78 | 107.54 | 107.23 |

To sum up, it can be clearly seen that in the embodiments provided by the invention, a polymerized polyphenol layer and a conductive layer are formed on the surface of nylon fiber without using a heavy metal sensitizer, to obtain a conductive nylon fiber. The preparation process is safe and environment-friendly. The conductive nylon fiber obtained by the method has excellent electrical conductivity and the strength of the nylon fiber is basically not damaged. The conductive layer is firmly bonded and does not easily fall off.

While preferred embodiments of the invention have been described above, the invention is not limited thereto. It should be appreciated that some improvements and variations can be made by those skilled in the art without departing from the technical principles of the invention, which are also contemplated to be within the scope of the invention.

What is claimed is:

1. A method for preparing a silver-plated conductive nylon fiber, comprising steps of:

(1) immersing a nylon fiber in an aqueous solution containing a polyphenolic compound at 60° C. to 70° C., adding a water-soluble oxidant into the solution, continuously reacting the resultant reaction solution at 70° C. to 80° C., and obtaining a polyphenol grafted nylon fiber after the reaction is completed, wherein the polyphenolic compound contains a catechol group, and the aqueous solution of the polyphenolic compound has a concentration of 1 g/L to 5 g/L;

(2) immersing the polyphenol grafted nylon fiber obtained in the step (1) into a solution containing silver ions at 15° C. to 25° C. for reaction, and raising the temperature to 70° C. to 80° C. for continuous reaction to obtain a surface-activated nylon fiber, wherein in the solution containing silver ions, the concentration of silver ions is $1\times10^{-5}$ mol/L to $3\times10^{-5}$ mol/L; and (3) carrying out chemical silver plating treatment on the surface-activated nylon fiber obtained in the step (2) to obtain the silver-plated conductive nylon fiber.

2. The method according to claim 1, wherein before the step (1), the method further comprises step (la): soaking the nylon fiber in sulfuric acid with a concentration of 20 mL/L to 100 mL/L at 40° C. to 60° C. for 20 to 120 min.

3. The method according to claim 1, wherein the chemical silver plating comprises: soaking the surface-activated nylon fiber obtained in the step (2) in a silver ammonia solution added with a reducing agent at 30° C. to 50° C. for reaction for 20 to 90 min.

4. The method according to claim 3, wherein the reducing agent is selected from the group consisting of glucose, acetaldehyde, formaldehyde or any combination thereof.

5. The method according to claim 3, wherein the silver ammonia solution is further added with a surfactant.

6. The method according to claim 5, wherein the surfactant comprises polyvinylpyrrolidone and/or sodium dodecyl benzene sulfonate.

7. The method according to claim 5, wherein the surfactant has a concentration of 5 g/L to 15 g/L.

8. The method according to claim 1, wherein in the step (1), the polyphenolic compound is selected from the group consisting of eugenol, tannic acid, ferulic acid, chlorogenic acid and any combination thereof; the water-soluble oxidant is selected from the group consisting of sodium perborate, potassium perborate, sodium persulfate and any combination thereof; and in the reaction solution, the water-soluble oxidant has a concentration of 1 g/L to 3 g/L.

9. The method according to claim 1, wherein after the step (3), the method further comprises a step (4): washing and dehydrating the silver-plated conductive nylon fiber, and drying at 90° C. to 140° C. for 2 to 10 min.

10. A silver-plated conductive nylon fiber prepared by the method according to claim 1.

* * * * *